United States Patent [19]

Iwakiri et al.

[11] Patent Number: 4,845,322

[45] Date of Patent: Jul. 4, 1989

[54] PLUNGER TYPE FLUID PRESSURE SWITCH

[75] Inventors: Norio Iwakiri, Kyoto; Hideyuki Bingo, Uji; Hiedji Tugui, Kyoto, all of Japan

[73] Assignee: Omron Tateisi Electronics Co., Kyoto, Japan

[21] Appl. No.: 136,623

[22] Filed: Dec. 22, 1987

[30] Foreign Application Priority Data

| | | | |
|---|---|---|---|
| Dec. 22, 1986 | [JP] | Japan | 61-198012 |
| Dec. 23, 1986 | [JP] | Japan | 61-307512 |
| Dec. 23, 1986 | [JP] | Japan | 61-198086 |
| Jul. 30, 1987 | [JP] | Japan | 62-117706 |
| Aug. 1, 1987 | [JP] | Japan | 62-118283 |

[51] Int. Cl.[4] ..... H01H 35/34

[52] U.S. Cl. ..... 200/81 R; 92/101; 73/723; 200/83 J

[58] Field of Search ..... 200/302.1, 306, 83 R, 200/83 A, 83 P, 83 S, 83 J, 83 W, 81 R, 82 R, 275, 283; 307/118; 91/1; 92/5 R, 101; 340/626; 73/717, 723, 745, 861.44

[56] References Cited

U.S. PATENT DOCUMENTS

| | | | |
|---|---|---|---|
| 3,444,341 | 5/1969 | Mighton | 200/83 J |
| 3,963,889 | 6/1976 | Stonich | 200/83 J |
| 4,195,209 | 3/1980 | Mlyniec | 200/83 J |
| 4,458,117 | 7/1984 | Johnson | 200/83 P |
| 4,464,551 | 8/1984 | Johnson | 200/83 J |
| 4,573,398 | 3/1986 | Johnson | 200/83 P |
| 4,638,721 | 1/1987 | Boulanger | 92/101 |
| 4,644,116 | 2/1987 | Miyakawa | 200/83 J |

*Primary Examiner*—Gerald P. Tolin

*Attorney, Agent, or Firm*—Wegner & Bretschneider

[57] ABSTRACT

A pressure receiving member which has a diaphragm held in a pressure receiving case is manufactured independently of a main sensor body member, which has a switch accommodated in a switch case. The pressure receiving member and the main sensor body member are then assembled to provide a pressure sensor.

According to the present invention, since the pressure receiving portion and the main sensor body are manufactured individually, a diaphragm inversion movement test can be carried out individually of the testing of switch turning on and off, and hence only satisfactory pressure receiving portion and main sensor body which passed the respective tests will be utilized in the operation of assembling pressure sensors.

3 Claims, 13 Drawing Sheets

PLUNGER TYPE FLUID PRESSURE SWITCH

BACKGROUND OF THE INVENTION

1. Field of the Invention

This invention relates to a pressure sensor for sensing fluid pressure to detect gas leakage or the like.

2. Discussion of the Related Art

For example, a pressure sensor for detecting gas leakages which is intended to be operated at a slight pressure of a water column of 20 to 80 mm is, as shown in FIG. 16, usually provided with a diaphragm 2 in a pressure receiving chamber 1 thereof. This diaphragm 2 is provided to cause a plunger 3 to move in association with the inverse movement of the diaphragm 2 in accordance with any change in the gas pressure. As a result of this, a switch 4 is turned on or off in synchronization with the movement of the plunger 3.

In this case, a pressure receiving case 5 which encloses the pressure receiving chamber 1 is secured to a predetermined device by screws 6 or the like and connects the pressure receiving chamber 1 to a gas passage through pressure receiving port 7.

However, this pressure sensor is put together in a way like that shown in FIG. 16, in which a case 8 accommodating the switch 4 and the pressure receiving case 5 are welded together. In this structure, where the diaphragm 2 and the switch 4 have already been integrated in the pressure sensor, the following problem is raised: that is, diaphragm inverse movement tests cannot be carried out separately from testing on-off switch operation. As a result of these, if either one of these tests shows the corresponding parts to be defective, the whole pressure sensor, including remaining part that may well be satisfactory, is judged to be a defective product, and this causes manufacturing yields to be poor.

SUMMARY OF THE INVENTION

One feature of the present invention is therefore to provide a pressure sensor in which the case for accommodating the switch and the pressure receiving case can respectively be individually tested.

Another feature of the present invention is to provide a pressure sensor that can be produced in high yields.

According to the present invention, a pressure sensor having a pressure receiving element which is arranged to transform in accordance with any change in fluid pressure and a switch which is turned on or off in accordance with the transformation of the pressure receiving element can be obtained in which a pressure receiving portion in which the pressure receiving element is held in the pressure receiving case which is connected to a predetermined device and the main sensor body in which the switch is accommodated in a switch base are manufactured individually, and the pressure receiving portion and the main sensor body are assembled to form the completed pressure sensor.

BRIEF DESCRIPTION OF THE DRAWINGS

The above and other objects, advantages and features of this invention will be more fully understood when considered in conjunction with the following figures, of which.

DETAILED DESCRIPTION OF THE DRAWINGS

Referring to the accompanying drawings, a first embodiment of the present invention will now be described.

Figure 1:
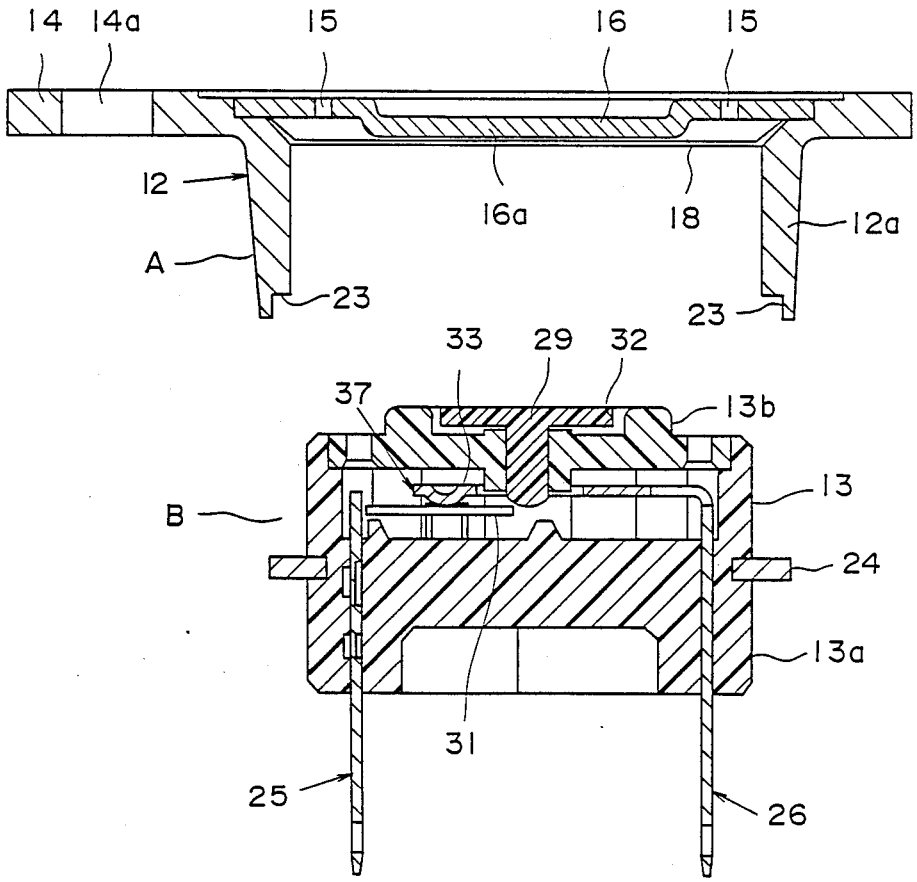
FIG. 1 is a cross-sectional view of a pressure sensor of an embodiment of the present invention and illustrating the separation of a pressure receiving portion and a main sensor body.
Figure 2:
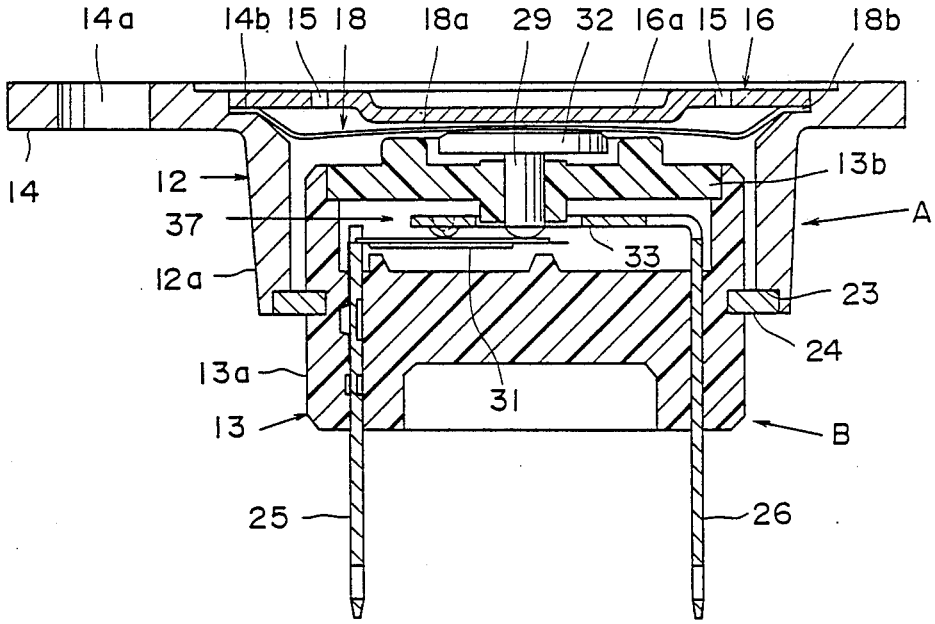
FIG. 2 is a cross-sectional view illustrating a state in which the pressure receiving portion and the main sensor body shown in FIG. 1 are assembled.
Figure 3:
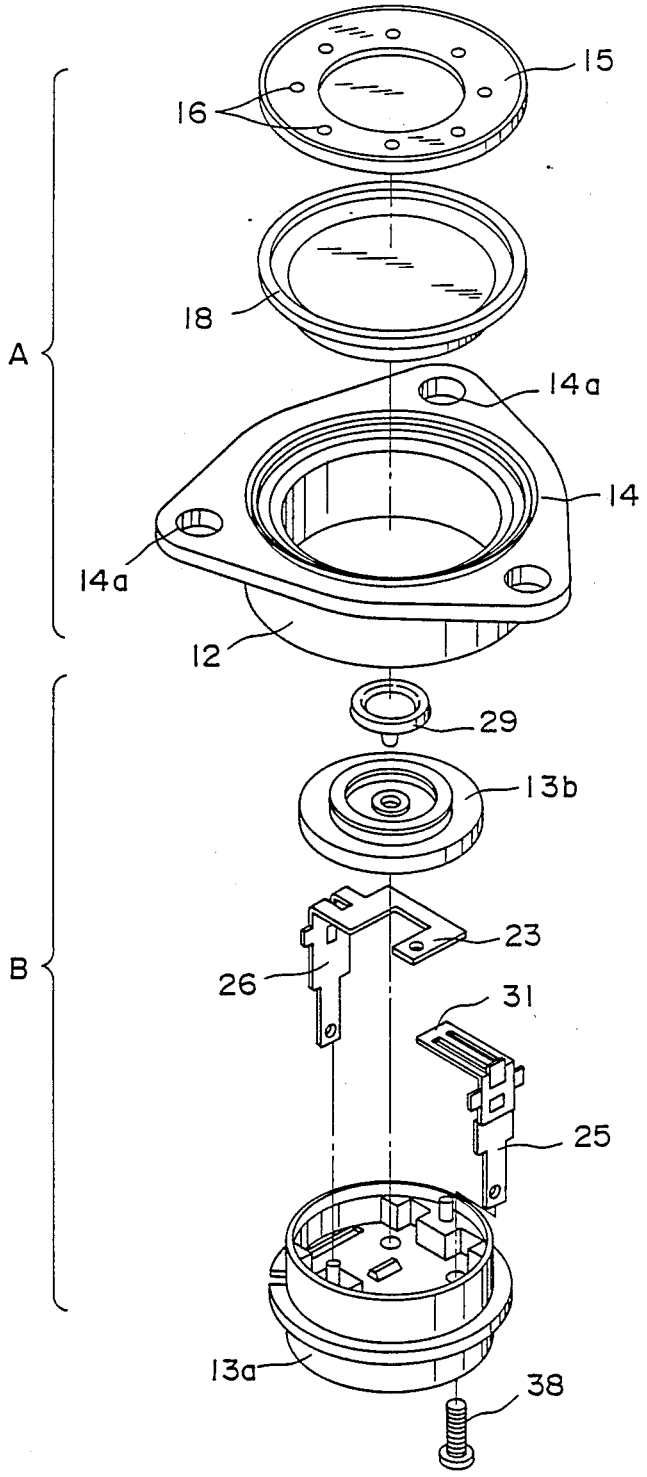
FIG. 3 is an exploded perspective view of the pressure sensor of FIG. 2.

FIGS. 1 to 3 show a pressure sensor for detecting gas leakages. The pressure sensor includes a pressure receiving portion A and a main sensor body B. The pressure receiving portion A in which a diaphragm 18 is held by a pressure receiving case 12 for connection to a predetermined device is made independently of the main sensor body B in which a switch 37 is accommodated in a switch case 13. This pressure receiving portion A and the main sensor body B are assembled to form the completed pressure sensor.

The pressure receiving case 12 of the pressure receiving portion A includes a pressure receiving flange 14 and a fastening hole **14*a* formed thereon through which the pressure sensor can be mounted on a predetermined device. Provided on the inner periphery of the pressure receiving flange 14 is a metallic diaphragm 18. Metallic diaphragm 18, especially the central portion thereof, can be partly displaced in alternate directions. A protection cap 16 is secured to case 12 together with metallic diaphragm 18 by arc welding, plasma welding, or the like. A predetermined number of passage holes 15 is bored in the protection cap 16 for the purpose of introducing a gas into the space between the protection cap 16 and the diaphragm 18**.

The pressure receiving case 12 has a cylindrical case portion 12*a*. A securing step 23 is formed on an inner edge of the cylindrical case portion 12*a*. The pressure receiving case 12 is made of a metallic material.

The switch case 13 of the main sensor body B is made of a synthetic resin. A metallic retaining plate 24 is provided on the switch case 13 at the outer intermediate position in the vertical direction of the switch case 13.

The retaining plate 24 radially projects from the outer periphery of the switch case 13. Therefore, when the main sensor body B is inserted in the cylindrical case portion 12*a* of the pressure receiving case 12, the securing step 23 is, as shown in FIG. 2, brought into engagement with the outer edges of the retaining plate 24, whereby the pressure receiving portion A and the main sensor body B are positioned.

The switch 37 is mounted on the inside of the switch case 13. This switch 37 comprises a movable contact member 31 and a fixed contact member 33 which have the corresponding terminals 25 and 26, respectively. These terminals 25 and 26 project from the switch case 13. In this embodiment, the switch case 13 comprises a switch base 13*a* and a cover 13*b*. The terminals 25 and 26 are press-fitted into the switch base 13*a*.

A plunger 29 is movably inserted into the cover 13*b* of the switch case 13. This plunger 29 presses the free end of the movable contact ember 31 which is made of a resilient material and forced upward.

The gap between the movable contact member 31 and the fixed contact member 33 which forms the switching stroke can be adjusted by a screw 38.

The independently manufactured pressure receiving portion A and the main sensor body B are subjected to the diaphragm inverse movement test and the switch test, respectively. Only the two parts which have passed the tests are combined and assembled to form a completed pressure sensor.

The main sensor body B is inserted into the pressure receiving case 12 of the pressure receiving portion so that securing step 23 is engaged with the retaining plate 24 for positioning the main sensor body B. The joined portions are laser-welded or arc-welded for fixing the aforementioned main sensor body B and the pressure receiving portion A.

In this fixed state, the top 32 of the plunger 29 is in contact with the diaphragm 18 because of the resilient force of the moving contact member 31. Therefore, when the pressure sensor is installed to a predetermined device and is operated, the plunger 29 is downwardly moved by the inverse movement of the diaphragm 18 responding to any change in the gas pressure, whereby the operation of the switch 37 is controlled.

As described above, in this embodiment, the pressure receiving portion A and the main sensor body B are manufactured independently of each other and respectively subjected to the diaphragm inverse movement test and the switch test, and then the pressure receiving portion A and the main sensor body B which have passed the tests can be combined.

In the conventional pressure sensor in which the aforementioned two members are integrally formed, if the diaphragm portion is defective in operation, both of the two members must be wasted even if the switch portion operates well. According to the present invention, however, since the member which has passed the test can be retained, a great economical advantage can be obtained.

Furthermore, since the pressure receiving case 12 for holding the diaphragm 18 also serves as a metallic joint for connecting the pressure sensor to a predetermined device, the number of parts can be decreased, and the number of steps of the manufacturing process for the pressure sensor can be decreased; furthermore, a compact and thin pressure sensor can be made.

A central portion of the surface of the protection cap 16 shown in FIG. 1 is provided with a downward-projecting portion 16*a*. Even if an excessive negative pressure caused by a gas leakage or the like is applied, the downward-projecting portion 16*a* prevents the diaphragm 18 from abnormal transformation.

Therefore, the diaphragm 18 can be protected from deterioration in performance and from fatigue. Since the downward-projecting portion 16*a* is integrally formed with the protection cap 16, the number of parts can be reduced in comparison with the conventional pressure sensor. Furthermore, long life of the diaphragm 18 can be achieved.

The diaphragm 18 need only to be mounted onto an annular step 14*b* formed on the pressure receiving flange 14 from one direction. Then, the protection cap 16 must be mounted onto the diaphragm 18 before welding the joint portions. As a result of this, the assembly can be easily carried out, whereby workability in assembling can be improved.

Since the members such as packings for holding the diaphragm 18 become unnecessary, the overall height of the pressure sensor can be lowered.

Furthermore, since the annular step 14*b* can be precisely machined, the stable positioning of the diaphragm 18 and a stable performance can be obtained.

Figure 4:
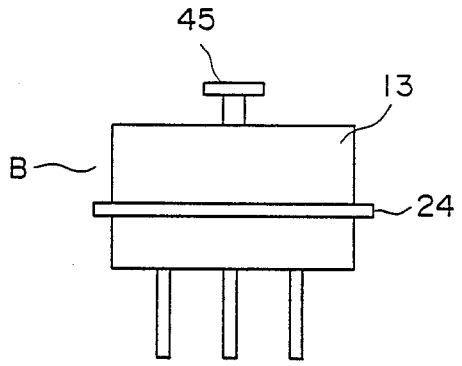
FIG. 4 is a side view of a switch portion of a second embodiment of the present invention.
Figure 5:
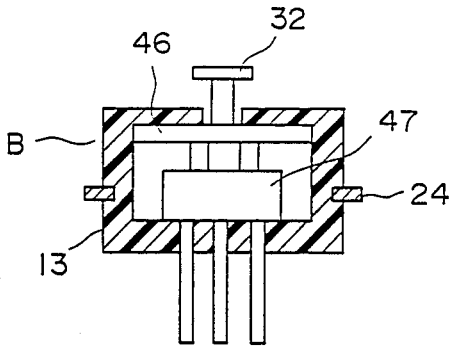
FIG. 5 is a cross-sectional view of a switch portion of a third embodiment of the present invention.
Figure 6:
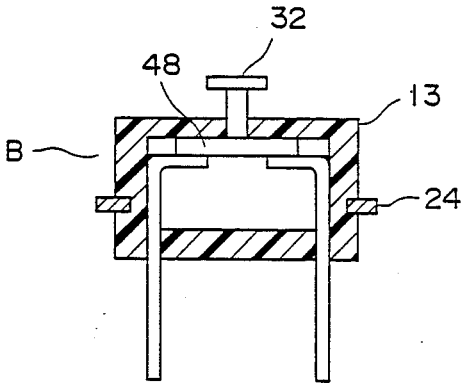
FIG. 6 is a cross-sectional view of a switch portion of a fourth embodiment of the present invention.
Figure 7:
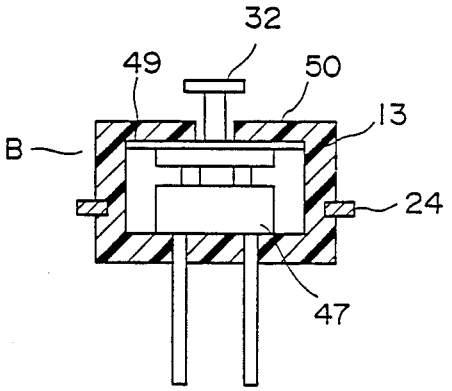
FIG. 7 is a cross-sectional view of a switch portion of a fifth embodiment of the present invention.

Although in this embodiment, the contact type of switch 37 is illustrated, an electrostatic capacity type as shown in FIG. 4, a diffused resistor type as shown in FIG. 5, a pressure sensitive rubber type as shown in FIG. 6, or a strain gauge type as shown in FIG. 7 may be also employed. According to the present invention, since the pressure receiving portion A and the main sensor body B are individually manufactured, the aforesaid types can be selectively combined. Similarly, a slow type diaphragm or the like can be employed as the diaphragm 18 of the pressure receiving portion A. In FIGS. 4 to 7, reference numeral 45 represents an electrode which also serves as a plunger. Reference numeral 46 represents a silicon substrate, and reference numeral 47 represents an electric circuit. Reference numeral 48 represents a pressure sensitive rubber. Reference numeral 49 represents a thin film, and reference numeral 50 represents a strain gauge.

Although the pressure sensor for detecting the gas leakage has been described, it should be widely understood that the present invention can be used for detecting a fluid pressure.

Figure 8:
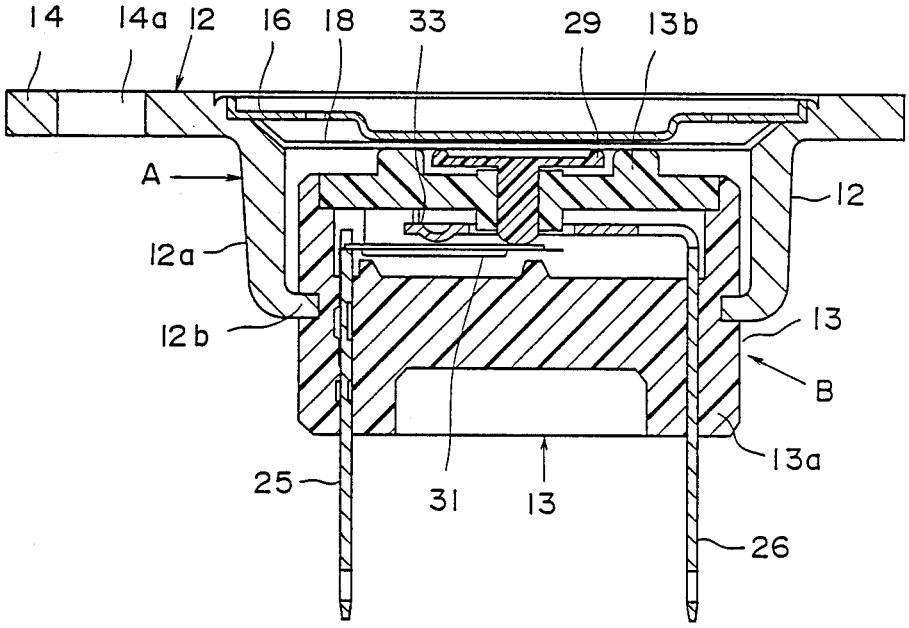
FIG. 8. is a cross-sectional view of a pressure sensor of a sixth embodiment of the present invention.
Figure 9:
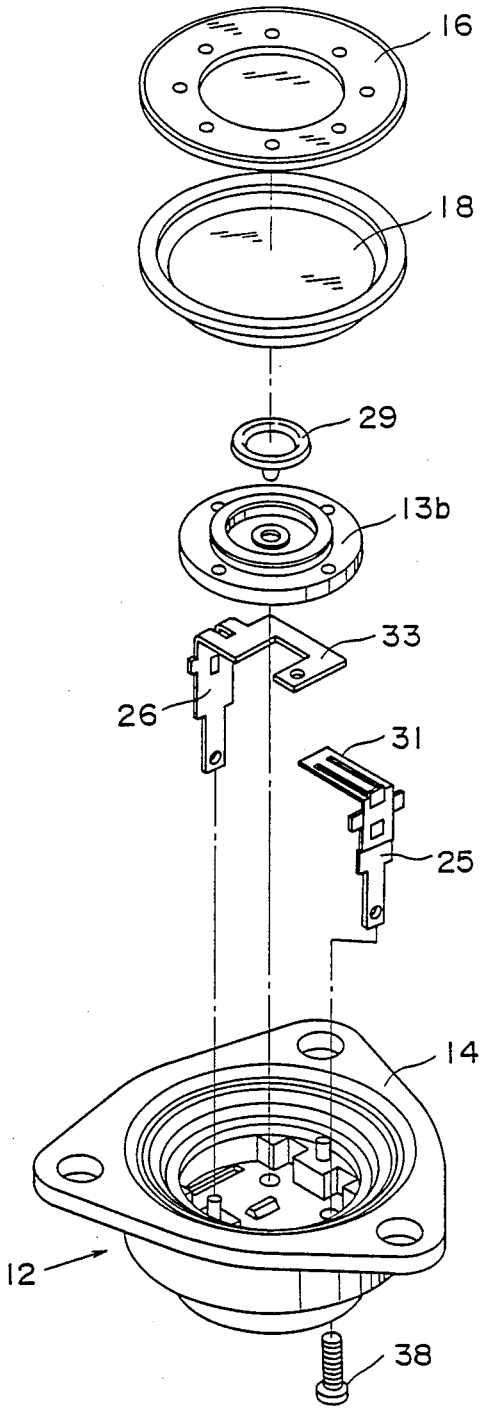
FIG. 9 is an exploded perspective view of the pressure sensor shown in FIG. 8.

A pressure sensor shown in FIGS. 8 and 9 comprises, like the pressure sensor shown in FIGS. 1 to 3, the pressure receiving portion A and the main sensor body B. However, the pressure receiving case 12 of the pressure receiving portion A is pressed onto the switch case 13 of the main sensor body B.

The terminals 25 and 26 are press-fitted into the switch base 13*a* onto which the pressure receiving case 12 is to be pressed. Then, the cover 13*b* is mounted and the plunger 29 is inserted so as to form the completed main sensor body B.

Then, the pressure receiving portion A is assembled. In more detail, the diaphragm 18 and the protection cap 16 are put on the pressure receiving flange 14 and their joints are welded together so as to form the completed pressure sensor.

That is, the end portion of the opening portion of the cylindrical case portion 12*a* of the pressure receiving case 12 is inwardly bent and projected to form an inserted portion 12*b*. When the switch base 13*a* of the switch case 13 is formed, this pressure receiving case 12 is pressed on via the end portion of the opening portion of the cylindrical case portion 12*a*.

As described above, since only the main sensor bodies B whose switch portions work well are provided with the pressure receiving portions A, a great manufacturing yield can be obtained.

Figure 10:
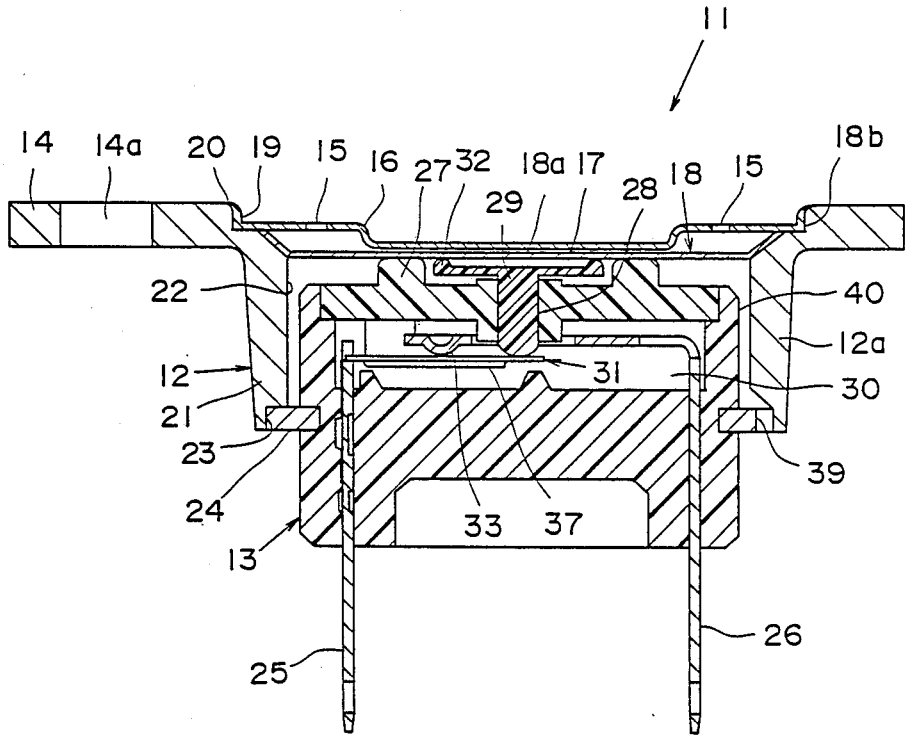
FIG. 10 is a vertical cross-sectional view of the seventh embodiment of the present invention.
Figure 11:
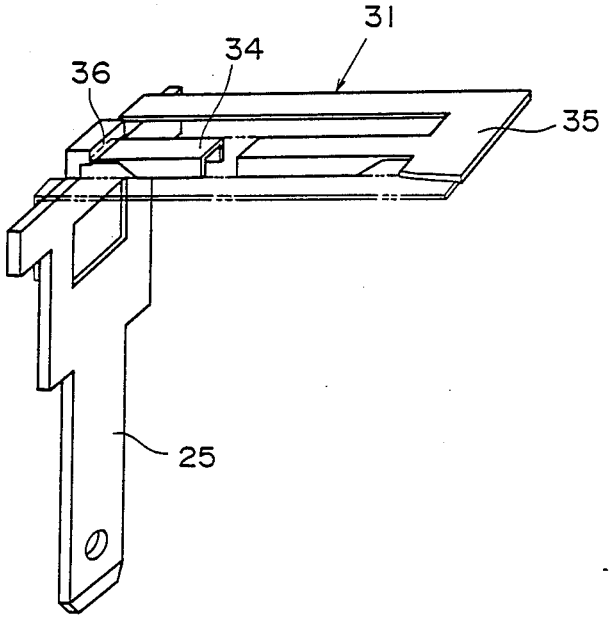
FIG. 11 is a perspective view of a lead terminal and a movable contact member for the pressure sensor shown in FIG. 10.

FIGS. 10 and 11 illustrate the seventh embodiment of the present invention. In FIGS. 10 and 11, the movable contact member 31 is made of a very thin electroconductive spring material. The base portion of the movable contact member 31 is connected to the upper edge of the first lead terminal 25 to serve as a supporting point. A free end 35 of the movable contact member 31 projects from the supporting point. The end portion 35 is arranged to contact the lower end of the plunger 29, while the upper surface of the intermediate portion of the projecting portion is arranged to be the movable contact 34.

In this case, in order to prevent the movable contact , 34 from excess warping caused by the elastic displacement of the movable contact member 31 to which the pressure of the plunger 29 is applied, the movable contact 34 is formed to have a U-shaped cross section for improving its rigidity. The end of the movable contact 34 is secured to the top securing step 36 of the first lead terminal 25 for restricting the upward movement of the movable contact 34. As a result of this, excessive deflection of the movable contact 34 is prevented. Consequently, suitable contacting and releasing motions of the contacts can be obtained. Furthermore, the increased rigidity gives the movable contact 34 a high resistance to vibration. Therefore, more improved switch reliability can be obtained.

When the plunger 29 is positioned at its lower position, it pushes down the movable contact member 31, whereby the two contacts 33 and 34 are moved away from each other. As a result of this, the electric connection between the two lead terminals 25 and 26 is broken. On the other hand, when the plunger 29 is positioned at its upper position, the movable contact member 31 upwardly moves so as to bring the two contacts 33 and 34 into contact each other, whereby the two lead terminals 25 and 26 are connected.

In this case, since the movable contact 34 has high rigidity, the deflection of the contact 34 can be kept small. As a result of this, stronger elastic force can be obtained at this intermediate position, whereby stable switching characteristics can be obtained.

The switch portion 37 which is provided on the switch base 13 is operated by means of the diaphragm 18 which can be inversely displaced in accordance with any change in the fluid pressure, such as a gas pressure. In this case, the gap between the small contacts 33 and 34 which vertically oppose each other can be adjusted by means of an adjusting screw 38 so as to make it suitable for switching.

A slit 39 is formed in the external edge of the connecting flange 24 for introducing air. The slit 29 forms part of an air passage 40 through which air is introduced or exhaled. Consequently, the slit 39 causes the diaphragm 18 to be easily operated in a transformation manner.

In the pressure switch constituted as described above, the inversely moving portion 18*a* of the diaphragm 18 transforms to form an arc. The plunger 29 which is pressed by the transformed surface pushes down the movable contact member 31, whereby the two contacts 33 and 34 are moved away from each other. Consequently, a predetermined pressure is detected.

When the fluid pressure is decreased, the inversely moving portion 18*a* of the diaphragm 18 is restored to its original form, thereby the plunger 29 is pushed upwardly by the force of the movable contact member 31, and simultaneously, the movable contact 34 of the movable contact member 31 is brought into contact with the fixed contact 33 which is disposed above the movable contact 34, whereby electricity is conducted. As a result of this, a signal showing the decrease in fluid pressure is output.

In this case, since the movable contact 34 is slightly deflected, a strong elastic force can be obtained. Thus, a high contacting pressure can be obtained.

Furthermore, since only one position serves as the contact, the contacting pressure can be concentrated on that position, whereby precise and stable switching characteristics can be obtained.

Figure 12:
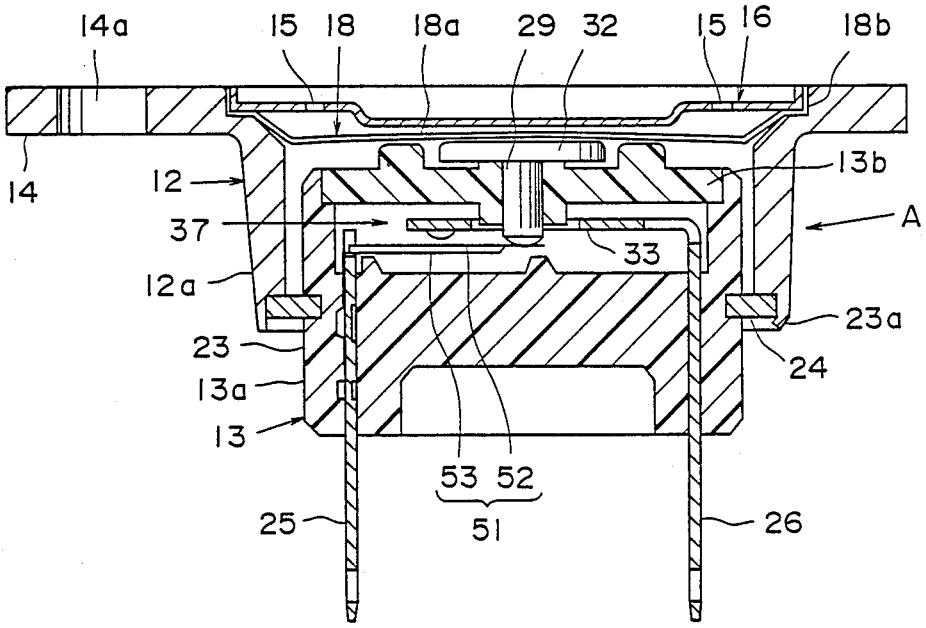
FIG. 12 is a cross-sectional view of an eighth embodiment of the present invention in which the pressure sensor switch is turned off.
Figure 13:
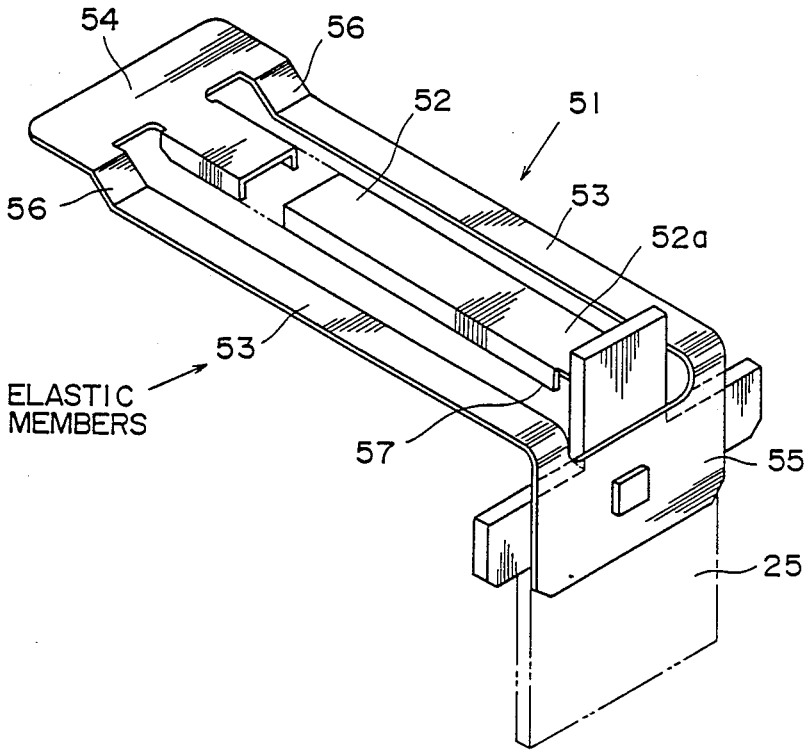
FIG. 13 is an enlarged perspective view of a movable contact member of the pressure sensor shown in FIG. 12.

FIGS. 12 and 13 illustrate the eighth embodiment of the present invention. A movable contact member 51, as shown in FIG. 12 in an enlarged manner, includes a rigid body 52 which is bent in a U-shape and disposed at the central portion, while elastic portions 53 and 53 for spring action are disposed on both sides. These two portions 52 and 53 are integrally formed via the free end connection portion 54 and the base connecting portion 55. This movable contact member 51 is an electroconductive contacting member. By way of forming steps 56 and 56 between the free end connection portion 54 and the elastic portions 53 and 53, the two elastic members 53 and 53 are formed in such a manner that the distance between the members 53 and the fixed contact member 33 is greater than that between the rigid body 52 and the contact member 33.

A base end 52*a* of the rigid body 52 is fitted into a groove 57 disposed in the upper portion of the terminal 25. The base connecting portion 55 is bent to form a L-shape and is secured to the backside of the terminal 25 via the L-shaped portion.

Since the two elastic members 53 and 53 are separated and lowered one step away from the fixed contact member 33, when the base connecting portion 55 is fixed to the backside of the terminal 25 via the L-shape portion, a predetermined gap between the top ends of the elastic members 53 and 53 and the bottom surface of the fixed conact member 33 can be sustained even if the elastic members 53 and 53 are to some extent warped upwardly by the intrinsic spring force of the metal which forms the movable contact member 51.

Therefore, as shown in FIG. 12, even if the diaphragm 18 is moved inversely to push down the plunger 29 for turning off the switch 37, the elastic members 53 and 53 do not contact the fixed contact member 33.

Thus, a relatively large gap between contacts can be achieved in comparison to the conventional pressure sensor and the stable switch operation can be obtained.

In this embodiment, the sensor main body B is inserted into the pressure receiving case 12 of the pressure receiving portion A and the retaining plate 24 is engaged with the thin cylindrical step 23. The lower end of the step 23 is partially, for example, at three equally spaced portions 23*a* disposed at an angle of 120 , deformed to fix the two portions of A and B.

In the aforementioned integrally formed state, the top portion 32 of the plunger 29 is brought into contact with the diaphragm 18 by the elastic force of the movable contact member 31. When the pressure sensor is mounted to a predetermined device for use, the plunger 29 is moved vertically by the inverse movement of the diaphragm 18 in accordance with the change in the gas pressure, whereby the switch 37 is operated.

Since the switch case 13 can be fixed to the pressure receiving case 12 by means of the deformed portions 23*a* which are disposed at the edges of the step 23, the following advantages can be obtained: the switch case 13 can be protected from heat conductance, which occurs in the conventional securing method in which the conventional welding is employed. Therefore, the switch case 13 can be protected from thermal deformation and the diaphragm 18 from deteriorating in performance.

Furthermore, in comparison with the productivity of the conventional sensors, the productivity of the sensors according to the present invention can be improved.

Furthermore, since the step 23 is deformed partially at the portions 23*a*, mechanical strain caused by deforming the portions 23*a* is so small that the diaphragm 18 can be protected from being deformed.

Figure 14:
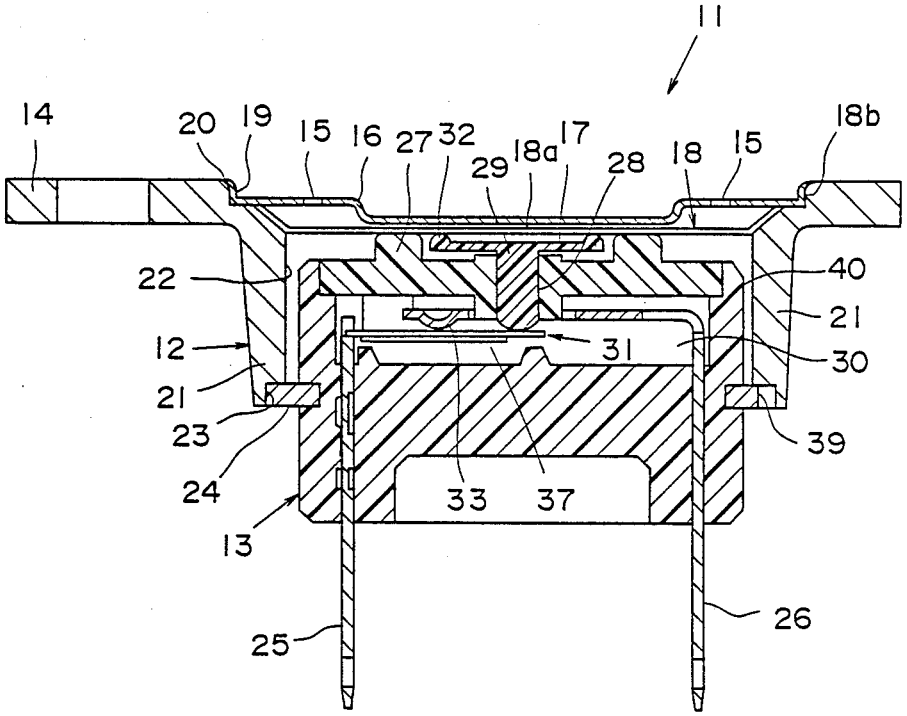
FIG. 14 is a vertical cross-sectional view of a pressure sensor of a ninth embodiment of the present invention.

FIG. 14 illustrates a ninth embodiment of the present invention in which the connecting flange 24 is provided with a slit 39 for introducing air between the switch base 13 and the case 21. The slit 39 communicates with an air passage 40 which is provided between the outer surface of the switch base 13 and the inner surface of the pressure receiving case 12. The upper surface of the diaphragm 18 receives fluid pressures while the lower surface thereof receives atmospheric pressures, whereby the transformation of the diaphragm 18 is allowed.

Figure 15:
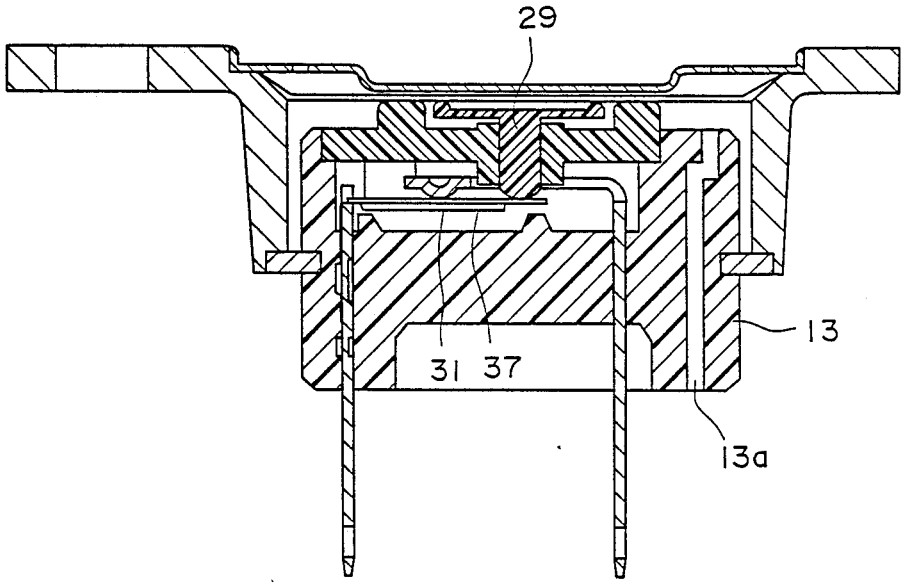
FIG. 15 is a vertical cross-sectional view of a pressure sensor of a tenth embodiment of the present invention.
Figure 16:
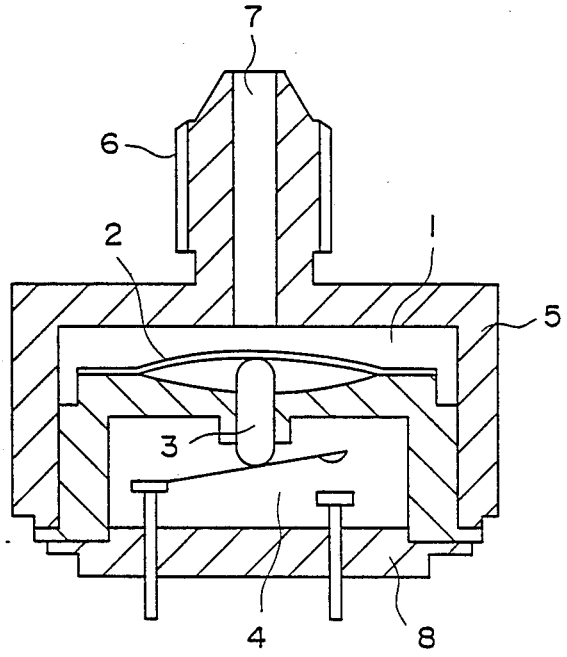
FIG. 16 PRIOR ART
FIG. 16 is a cross-sectional view of a conventional pressure sensor.

FIG. 15 illustrates the tenth embodiment of the present invention. The air passage 13*a* is vertically formed through the switch base 13, whereby air can be introduced into the pressure sensor through the passage 13*a*. Even if this air passage 13 is provided, dust or water drops do not easily invade the sensor. Even if they invade, they can be stopped by the plunger 29, whereby the switch contacting portion which is disposed inside can be prevented from deterioration because of the dust or water drops. As a result of this, the reliability is improved. In this embodiment, the other structures are the same as those shown in FIGS. 1 and 2.

In the pressure sensor which has the structure described above, when the diaphragm 18 receives a fluid pressure, the inversing portion 18*a* of the diaphragm 18 is transformed in an arc shape, and pushes down the plunger 29. The plunger 29 downwardly presses the movable contact 31, whereby the two contacts 33 and 34 are moved away from each other. As a result of this, a predetermined fluid pressure is detected.

When the fluid pressure is decreased, the inversing portion 18*a* of the diaphragm 18 is restored to its original shape. As a result of which, the plunger 29 is pushed upwardly by the force of the movable contact member 31. Simultaneously, the movable contact 34 of the movable contact member 31 is brought into contact with the fixed contact 33 which is disposed above the movable contact 34. As a result of this, electricity is conducted and a signal showing the decrease in fluid pressure is outputted.

In this embodiment, the length between the outer surface of the switch base 13 and the switch portion 37 is long and the plunger 29 closes the switch portion 37 during the switch-on state. Therefore, when the diaphragm 18 is moved inversely, that is, when air is introduced, even if dust or water drops are introduced together through the air passage 13*a* from the outside, the introduced dust or water drops are prevented from being introduced to the switch contacting portion which is disposed inside of the device. As a result of this, the switch contacting portion can be protected against deleterious influences, whereby a reliable switch can be achieved.

Furthermore, if water is retained inside the sensor through the air passage, the water can be easily removed because it can evaporate through the air passage, and a filter which causes air flow resistance to be increased is not used, high-speed response of the switch can be achieved, and error in the switch operation can be also prevented.

As described above, even if the air passage is provided, dust ingress can be sufficiently prevented. Furthermore, a pressure switch which is dust-proof and can quickly respond to a slight pressure change can be obtained.

In all the drawings figures in this application, like numerals designate like corresponding components. The above description and the accompanying drawings are merely illustrative of the application of the principles of the present invention and are not limiting. Numerous other arrangements which employ the principles of the invention and which fall within its spirit and scope may be readily devised by those skilled in the art. Accordingly, the invention is not limited by the foregoing description, but only limited by the scope of the appended claims.

We claim:

1. A pressure sensor comprising:

a pressure receiving element which transforms in response to any change in the pressure of a fluid;

a plunger which is adapted to move in response to the transformation of said pressure receiving element;

a movable contacting member which is pressed by said plunger, said movable contacting member comprising a rigid body and one or more resilient portions adjacent to sides of the rigid body; and a switch portion which is disposed such as to oppose said movable contacting member and has a fixed contacting member including a fixed contact, wherein said movable contacting member has a free end which acts in accordance with the movement of said plunger, an intermediate portion which is arranged to be brought into contact with said fixed contact, and a base portion which is arranged to serve as a supporting point.

2. A pressure sensor in claim 1, wherein said one or more resilient portions have steps thereon permitting travel below the rigid body.

3. A pressure sensor according to claim 1, further comprising a pressure receiving case in which the pressure receiving element is housed and a protecting member disposed over he pressure receiving element for protecting the pressure receiving element.

* * * * *